US012135037B1

(12) United States Patent
Yao

(10) Patent No.: US 12,135,037 B1
(45) Date of Patent: Nov. 5, 2024

(54) CEILING FAN BLADE SNAP-FIT STRUCTURE

(71) Applicant: Chao Chin Yao, Taichung (TW)

(72) Inventor: Chao Chin Yao, Taichung (TW)

( * ) Notice: Subject to any disclaimer, the term of this patent is extended or adjusted under 35 U.S.C. 154(b) by 0 days.

(21) Appl. No.: 18/432,363

(22) Filed: Feb. 5, 2024

(51) Int. Cl.
*F04D 29/34* (2006.01)
*F04D 25/08* (2006.01)

(52) U.S. Cl.
CPC ..... *F04D 29/34* (2013.01); *F04D 25/088* (2013.01)

(58) Field of Classification Search
CPC ..... F04D 29/34; F04D 25/088; F04D 29/322
See application file for complete search history.

(56) References Cited

U.S. PATENT DOCUMENTS 4,331,413 A * 5/1982 Hoen ..... F16B 19/1081 411/55
6,267,543 B1 * 7/2001 David ..... F16B 21/02 411/549
6,371,729 B1 * 4/2002 Tseng ..... F04D 25/088 416/244 R
6,758,626 B1 * 7/2004 Tseng ..... F04D 25/088 403/14
6,932,576 B2 * 8/2005 Bird ..... F04D 29/34 416/207
8,337,162 B2 * 12/2012 Bucher ..... F04D 25/088 403/302
8,356,979 B2 * 1/2013 Haynes ..... F04D 25/088 416/228
8,985,959 B1 * 3/2015 Kuykendall ..... F04D 29/34 416/210 R
9,651,058 B1 * 5/2017 Mares ..... F04D 29/34
2004/0009068 A1 * 1/2004 Pearce ..... F04D 29/34 416/210 R
2004/0013527 A1 * 1/2004 Pearce ..... F04D 25/088 416/210 R
2004/0136780 A1 * 7/2004 Tseng ..... F04D 29/34 403/368
2004/0197193 A1 * 10/2004 Bird ..... F04D 25/088 416/210 R
2004/0208747 A1 * 10/2004 Pearce ..... F04D 29/34 416/210 R
2010/0104442 A1 * 4/2010 Haynes ..... F04D 29/34 417/423.1
2019/0032673 A1 * 1/2019 Tang ..... F04D 25/088
(Continued)

*Primary Examiner* — Aaron R Eastman
(74) *Attorney, Agent, or Firm* — Muncy, Geissler, Olds & Lowe, P.C.

(57) ABSTRACT

A ceiling fan blade snap-fit structure has a blade holder and a blade. The blade holder has a coupling seat. A rotating member is provided on the coupling seat. A plurality of posts are provided beside the rotating member. The blade has a coupling hole for the rotating member to pass therethrough. An engaging block is provided at either side of the coupling hole. An indentation is formed on a top of the engaging block. The engaging block has two slopes at two sides of the indentation. The slopes each extend downwardly toward the coupling hole. A bottom of the engaging block is formed with grooves for receiving the respective posts. When the rotating member passes through the coupling hole and the rotating member is rotated, two ends of the rotating member are moved along the corresponding slopes and engaged in the indentations of the respective engaging blocks.

8 Claims, 9 Drawing Sheets

(56) References Cited

U.S. PATENT DOCUMENTS

| | | | | |
|---|---|---|---|---|
| 2023/0111026 | A1* | 4/2023 | Wang | F04D 29/34<br>416/210 R |
| 2023/0313813 | A1* | 10/2023 | Botkin | F04D 29/34<br>416/210 R |

* cited by examiner

CEILING FAN BLADE SNAP-FIT STRUCTURE

FIELD OF THE INVENTION

The present invention relates to a fan blade coupling structure, and more particularly, to a ceiling fan blade snap-fit structure.

BACKGROUND OF THE INVENTION

In a conventional ceiling fan, fan blades are locked to a blade holder through multiple screws. However, this way requires tools (such as screwdrivers) for locking the fan blades one by one, which makes the assembly or disassembly of the fan blades troublesome and inconvenient. During the operation of the ceiling fan, the connection between the fan blades and the blade holder may come loose, which is likely to cause harm or injury to the user. Accordingly, the inventor of the present invention has devoted himself based on his many years of practical experiences to solve these problems.

SUMMARY OF THE INVENTION

The primary object of the present invention is to provide a ceiling fan blade snap-fit structure, which enables operators to easily and quickly complete the assembly or disassembly of fan blades without using any tools and has the effect of ensuring the stability of the assembly of the fan blades.

In order to achieve the above object, the present invention provides a ceiling fan blade snap-fit structure, comprising a blade holder and a blade. One end of the blade holder has a coupling seat. A rotating member is provided on the coupling seat. The rotating member is rotatable relative to the coupling seat. A plurality of posts are provided beside the rotating member. The blade has a coupling hole for the rotating member to pass therethrough. An engaging block is provided at either side of the coupling hole. An indentation is formed on a top of the engaging block. The engaging block has two slopes at two sides of the indentation. The slopes each extend downwardly toward the coupling hole. A bottom of the engaging block is formed with grooves for receiving the respective posts. When the rotating member passes through the coupling hole and the rotating member is rotated, two ends of the rotating member are moved along the corresponding slopes and engaged in the indentations of the respective engaging blocks.

Preferably, the end of the blade holder is formed with a plate-shaped connecting end. The coupling seat has a shaft extending upwardly for connecting the rotating member. The posts are located beside the shaft. The connecting end has through holes corresponding in position to the shaft and the respective posts. The shaft and the posts of the coupling seat pass through the respective through holes and extend out of an upper end face of the connecting end. A plurality of screws are threadedly connected to the connecting end and the coupling seat, so that the coupling seat is locked to the connecting end.

Preferably, the coupling seat has a shaft extending upwardly. The posts are located beside the shaft. The rotating member has a plate portion in the form of an elongate plate and a sleeve portion extending downward from a center of the plate portion. The sleeve portion of the rotating member is sleeved on the shaft so that the rotating member is rotatable relative to the shaft of the coupling seat. The shaft is locked with a positioning member located in the sleeve portion. An elastic member is provided between a head end of the positioning member and an inner flange of the sleeve portion for generating a downward force against the rotating member.

In another embedment, the end of the blade holder is integrally formed with the coupling seat, the coupling seat has a shaft extending upwardly for connecting the rotating member, and the posts are located beside the shaft.

DETAILED DESCRIPTION OF THE PREFERRED EMBODIMENTS

Embodiments of the present invention will now be described, by way of example only, with reference to the accompanying drawings.

Referring to FIG. 1 through FIG. 6, the present invention provides a ceiling fan blade snap-fit structure, comprising a blade holder 11, a rotating member 21, and a blade 31.

Figure 3:
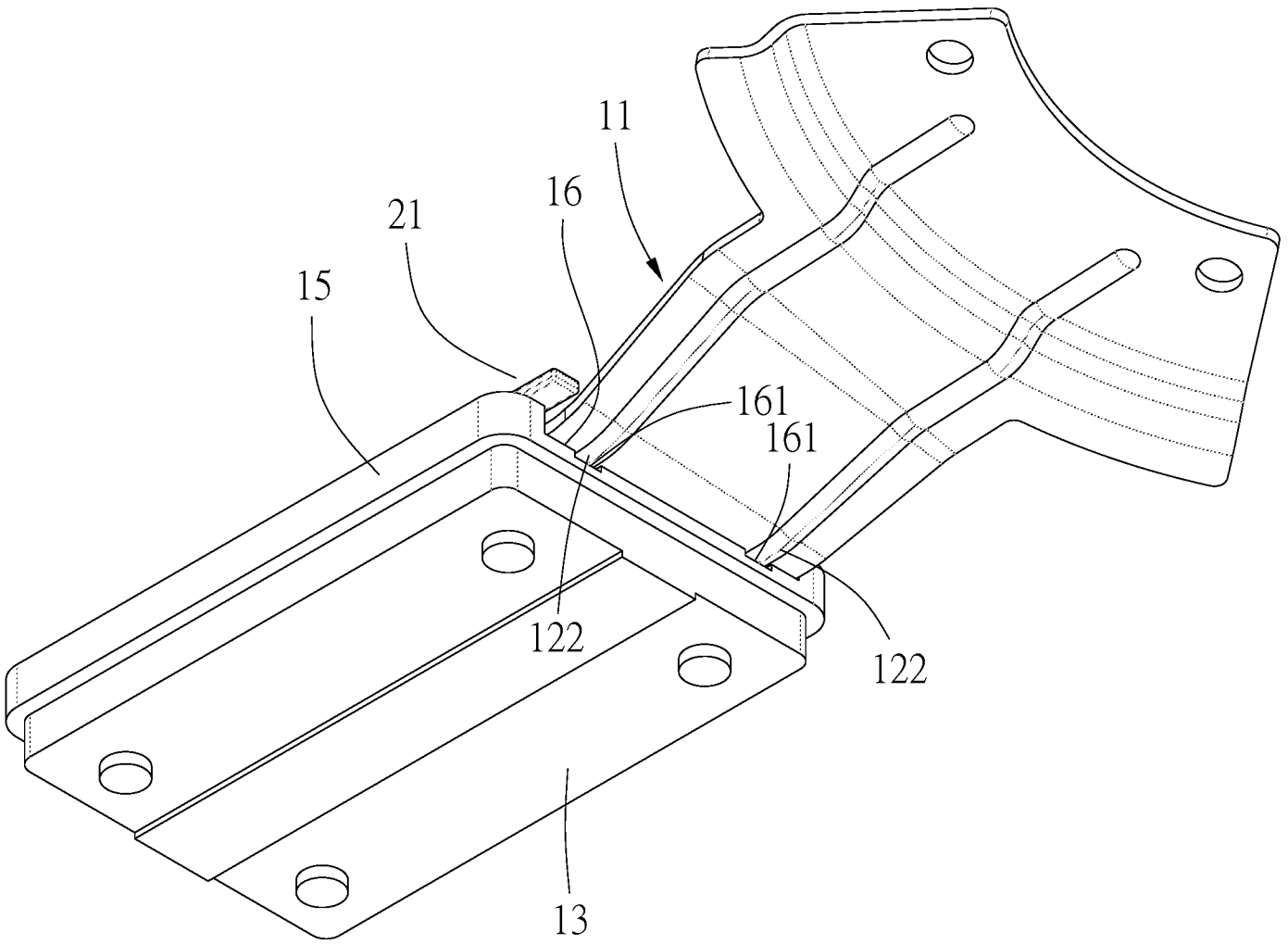
FIG. 3 is a schematic view illustrating the combination of the blade holder and the coupling seat of the present invention.

The blade holder 11 has one end extending outwardly to form a plate-shaped connecting end 12. A coupling seat 13 is connected to the connecting end 12. The coupling seat 13 has a shaft 131 extending upwardly and a plurality of posts 132 located beside the shaft 131. In this embodiment, the number of the posts 132 is four. The posts 132 are arranged symmetrically in pairs around the shaft 131. The connecting end 12 has through holes 121 corresponding in position to the shaft 131 and the respective posts 132. The shaft 131 and the posts 132 of the coupling seat 13 pass through the respective through holes 121 and extend out of the upper end face of the connecting end 12. A plurality of screws 14 are threadedly connected to the connecting end 12 and the coupling seat 13, so that the coupling seat 13 is locked to the connecting end 12. Further, the coupling seat 13 has a surrounding wall 15 along its peripheral circumference. A notch 16 is formed on one side of the surrounding wall 15 for the connecting end 12 to be inserted therethrough. When the connecting end 12 is connected to the coupling seat 13, the connecting end 12 is relatively accommodated in the space enclosed by the surrounding wall 15. A plurality of recesses 161 are formed on the side edge of the notch 16, facing the connecting end 12. The connecting end 12 includes a plurality of protruding ribs 122 corresponding in position to the respective recesses 161. When the connecting end 12 is connected to the coupling seat 13, the protruding ribs 122 of the connecting end 12 are engaged with the respective recesses 161 of the coupling seat 13 (as shown in FIG. 3) to further enhance the stability of the combination of the connecting end 12 and the coupling seat 13.

Figure 1:
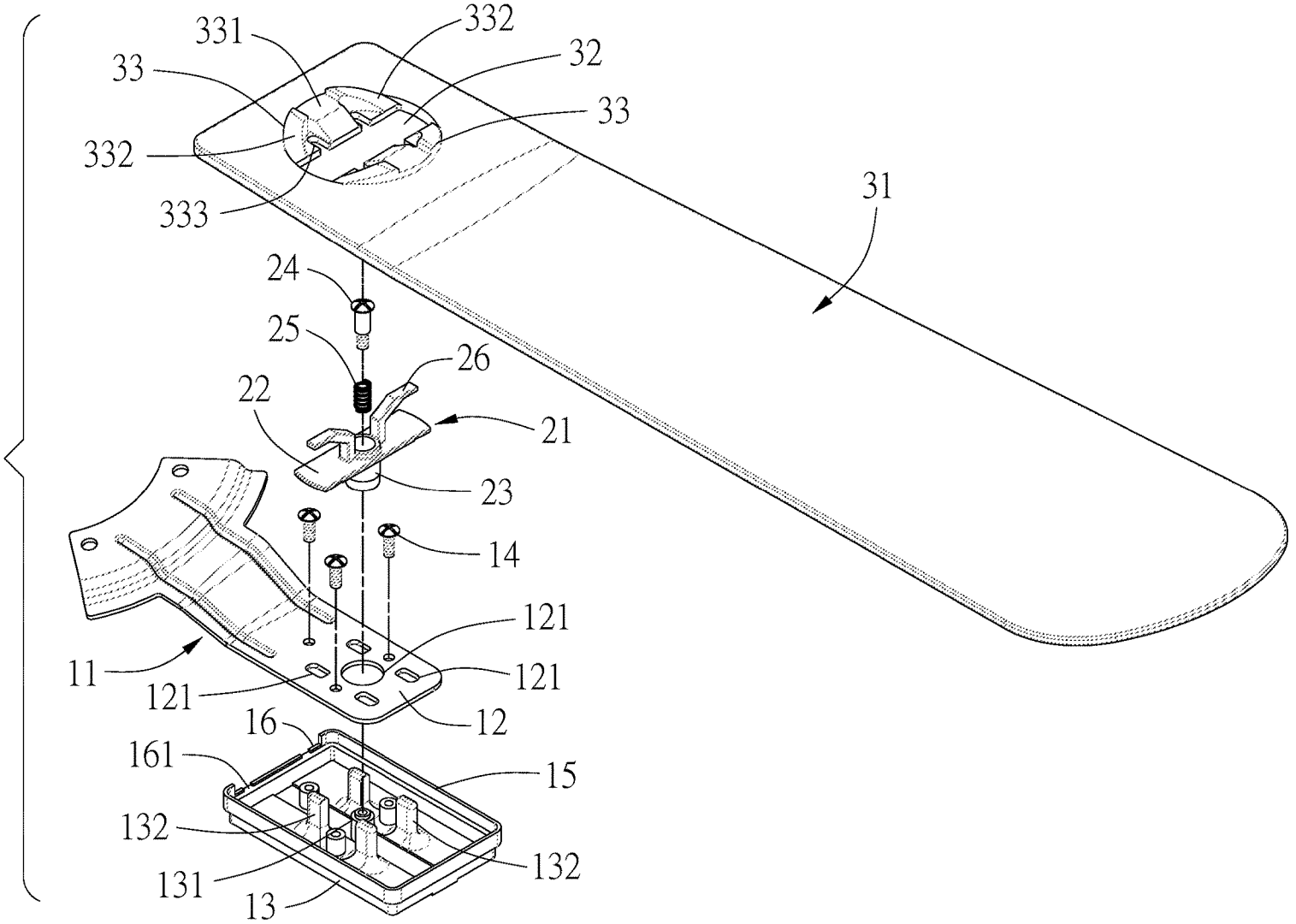
FIG. 1 is an exploded view of the present invention.
Figure 6:
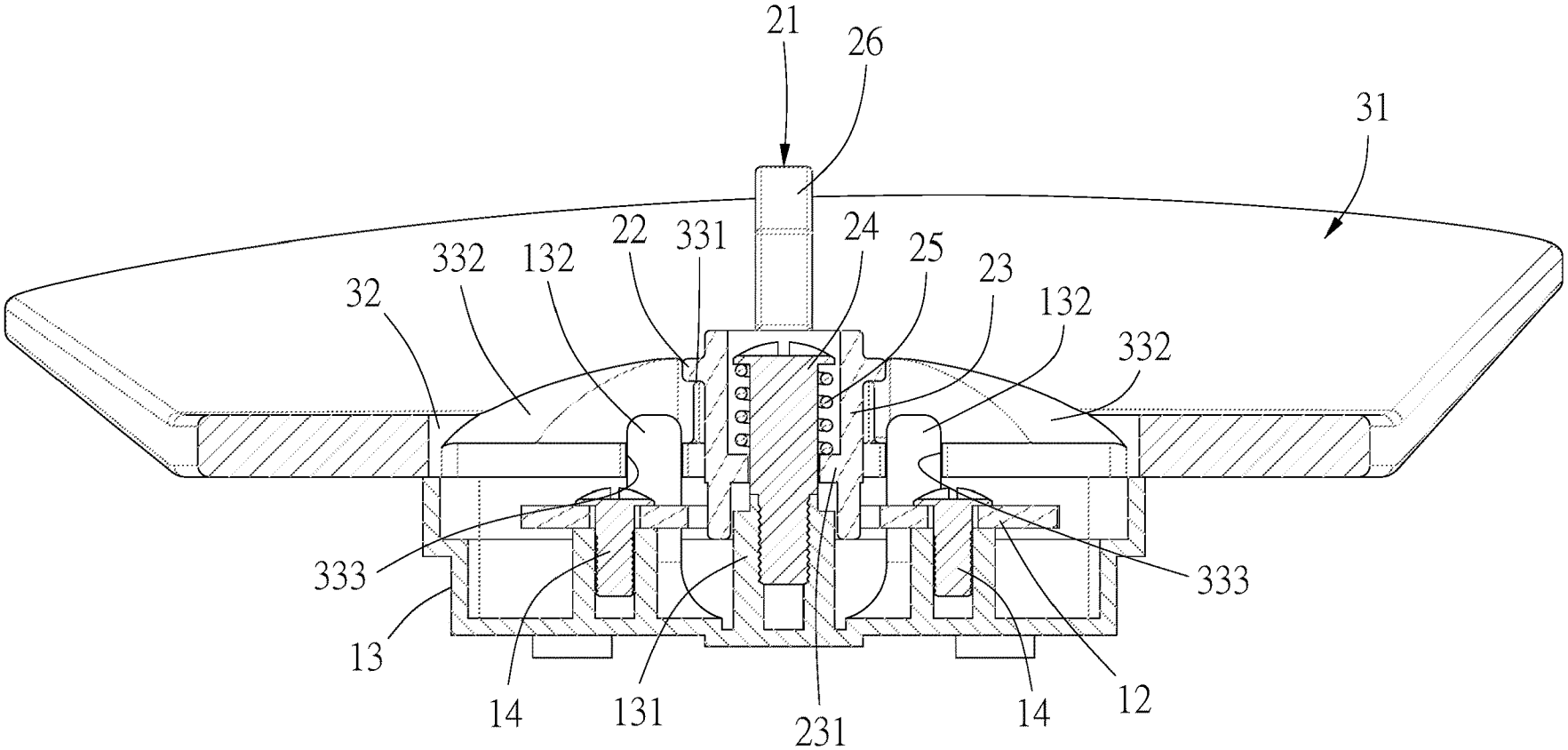
FIG. 6 is a cross-sectional view of the present invention, wherein the rotating member is rotated to be engaged with the indentations.

The rotating member 21 has a plate portion 22 in the form of an elongate plate and a sleeve portion 23 extending downward from the center of the plate portion 22. The sleeve portion 23 of the rotating member 21 is sleeved on the shaft 131, so that the rotating member 21 is rotatable relative to the shaft 131 of the coupling seat 13. The shaft 131 is locked with a positioning member 24 located in the sleeve portion 23. As shown in FIG. 1 and FIG. 6, an elastic member 25 in the form of a spring is provided between the head end of the positioning member 24 and an inner flange 231 of the sleeve portion 23 for generating a downward force against the rotating member 21. The rotating member 21 further has a pair of hook portions 26 on the upper end face of the plate portion 22. The hook portions 26 are symmetrically curved for the operator to rotate the rotating member 21 with his/her fingers.

The blade 31 has one end formed with a coupling hole 32. The coupling hole 32 is in the form of a slot corresponding in shape to the plate portion 22 of the rotating member 21 for the rotating member 21 coupled to the coupling seat 13 to pass through and extend out of the coupling hole 32. An engaging block 33 extending upwardly is provided at either long side of the coupling hole 32. An indentation 331 is formed on the top of the engaging block 33. The engaging block 33 has two slopes 332 at two sides of the indentation 331. The slopes 332 each extend downwardly toward the long side of the coupling hole 32. The bottom of the engaging block 33 is formed with grooves 333 for receiving the respective posts 132. When the blade 31 is coupled to the coupling seat 13, the engagement of the grooves 333 and the posts 132 provides a positioning effect.

Figure 2:
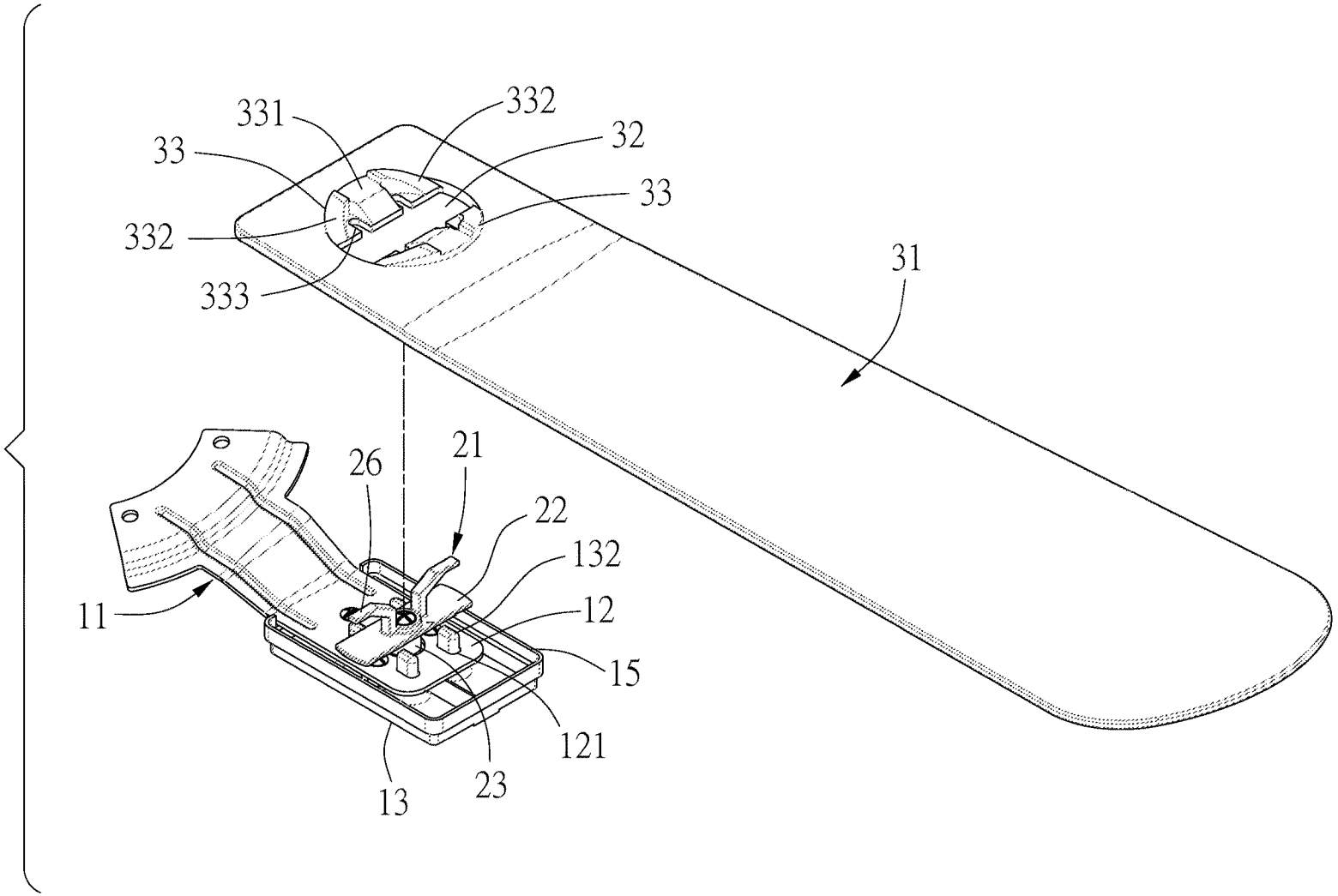
FIG. 2 is a schematic view illustrating the assembly of the blade of the present invention.
Figure 4:
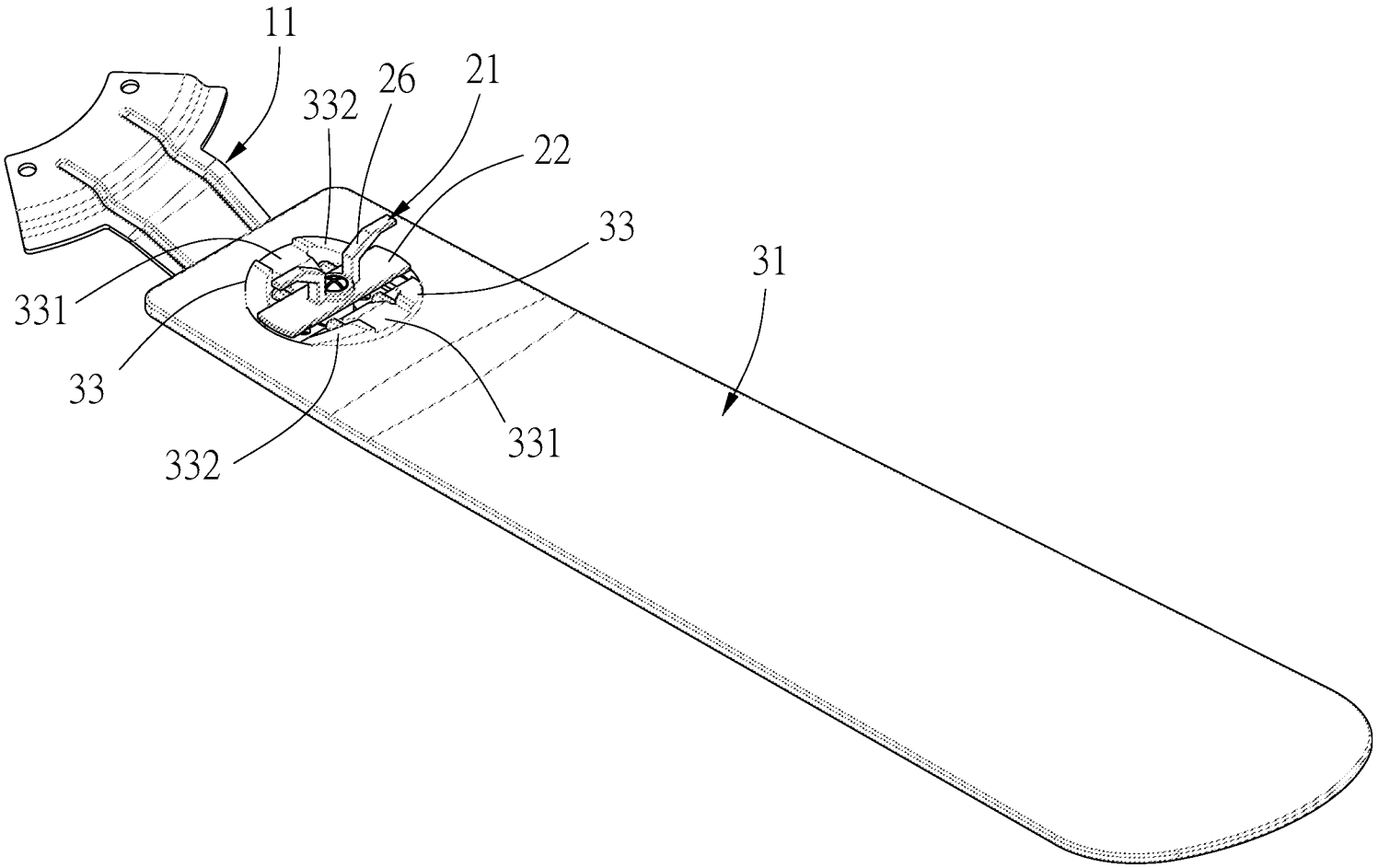
FIG. 4 is a schematic view of the present invention in a use state, wherein the rotating member passes through the coupling hole.
Figure 5:
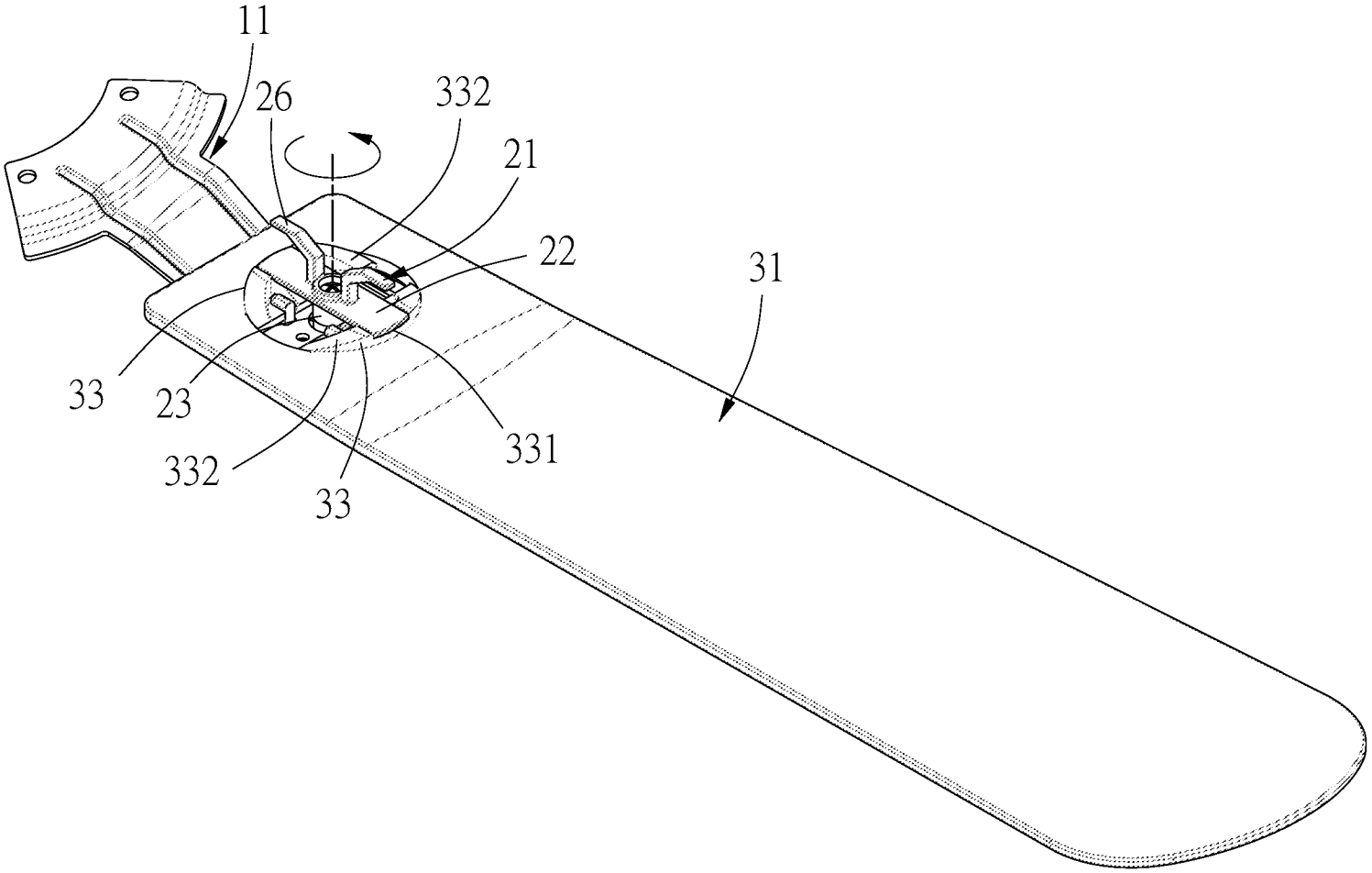
FIG. 5 is a schematic view of the present invention in a use state, wherein the rotating member is rotated to be engaged with the indentations.

When the blade 31 of the present invention is to be assembled, as shown in FIG. 2 and FIG. 4, the rotating member 21 on the coupling seat 13 passes through the coupling hole 32 of the blade 31, and the posts 132 of the coupling seat 13 are engaged with the respective grooves 333 of the blade 31. After that, as shown in FIG. 5 and FIG. 6, the operator turns the hook portions 26 of the rotating member 21 with his/her fingers to rotate the plate portion 22 synchronously, such that the plate portion 22 is gradually moved upward along the slopes 332 of the engaging blocks 33 and compresses the clastic member 25 in the process of rotation. When the two ends of the plate portion 22 are rotated to be above the respective indentations 331 of the engaging blocks 33, due to the return force of the elastic member 25, the two ends of the plate portion 22 of the rotating member 21 are forced to move downward and are engaged in the indentations 331. In this way, the assembly of the blade 31 is completed simply and quickly without using any tools. The posts 132 of the coupling seat 13 are engaged in the respective grooves 333 of the blade 31, providing a horizontal blocking effect on the blade 31. The elastic member 25 rebounds downward against the plate portion 22 of the rotating member 21 for the two ends of the plate portion 22 to be engaged in the respective indentations 331, providing a horizontal and vertical blocking effect on the blade 31. This prevents the blade 31 from shaking or detaching during operation.

When the blade 31 is to be detached from the coupling seat 13, the operator holds and pulls the hook portions 26 of the rotating member 21 upward with his/her fingers, so that the elastic member 25 is compressed to move the two ends of the plate portion 22 of the rotating member 21 upward to disengage from the respective indentations 331. Then, the rotating member 21 is rotated until the plate portion 22 is rotated to a position that is aligned with the coupling hole 32, such that the blade 31 can be removed from the coupling seat 13 quickly. The blade 31 can be assembled or disassembled easily and quickly. Thus, the present invention is very practical.

Figure 7:
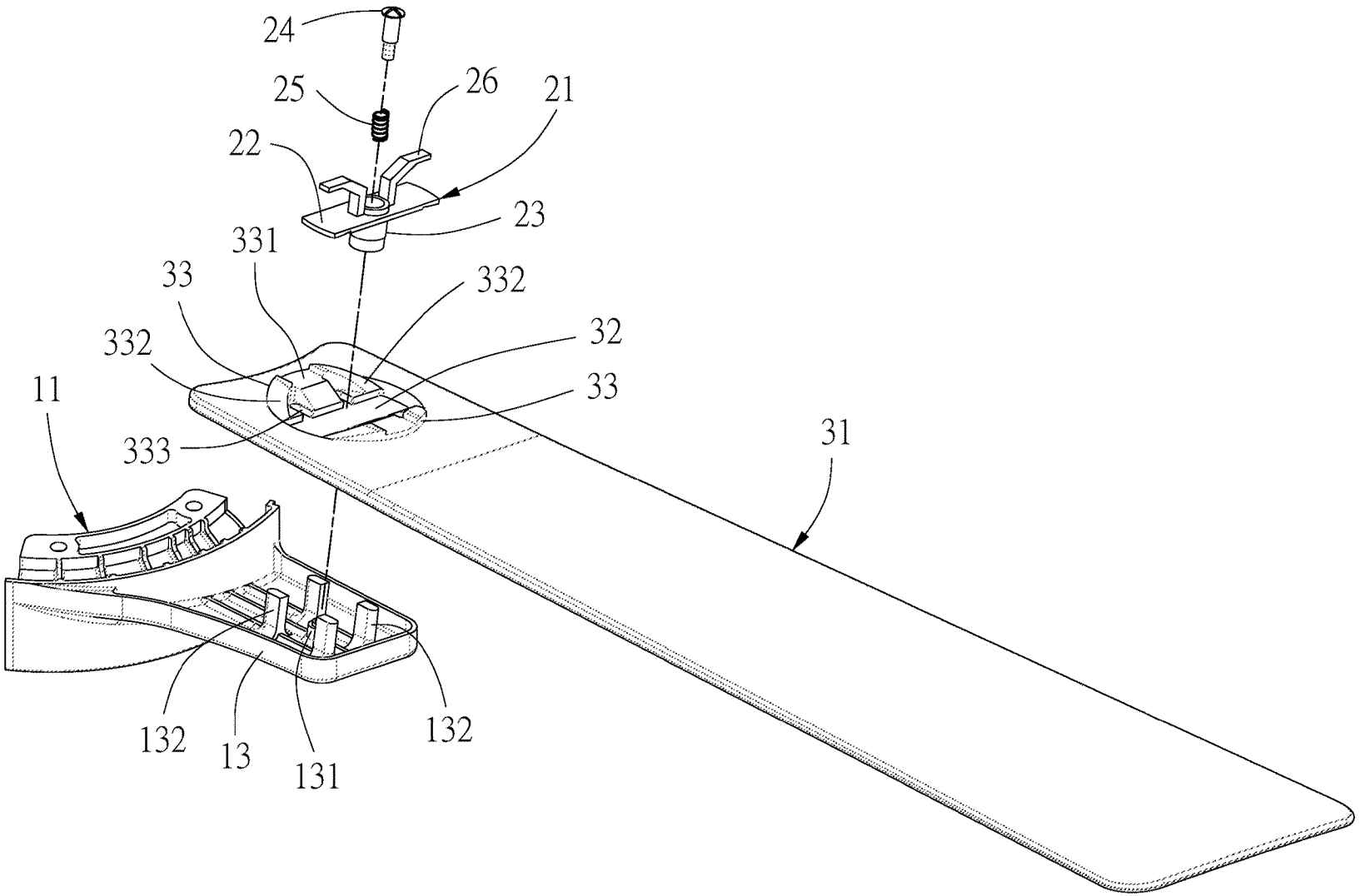
FIG. 7 is an exploded view of another embodiment of the present invention.

FIG. 7 illustrates another embodiment of the present invention, which is substantially similar to the foregoing embodiment with the exceptions described below. One end of the blade holder 11 is integrally formed with the coupling seat 13. The coupling seat 13 has a shaft 131 extending upwardly 131 for connecting the rotating member 21 and a plurality of posts 132 located beside the shaft 131. After the rotating member 21 is connected to the shaft 21, the rotating member 21 on the coupling seat 13 passes through the coupling hole 32 of the blade 31 and is locked by the engaging blocks 33. The blade 31 can be assembled/disassembled quickly, and the stability of the assembly of the blade 31 can be ensured.

Figure 8:
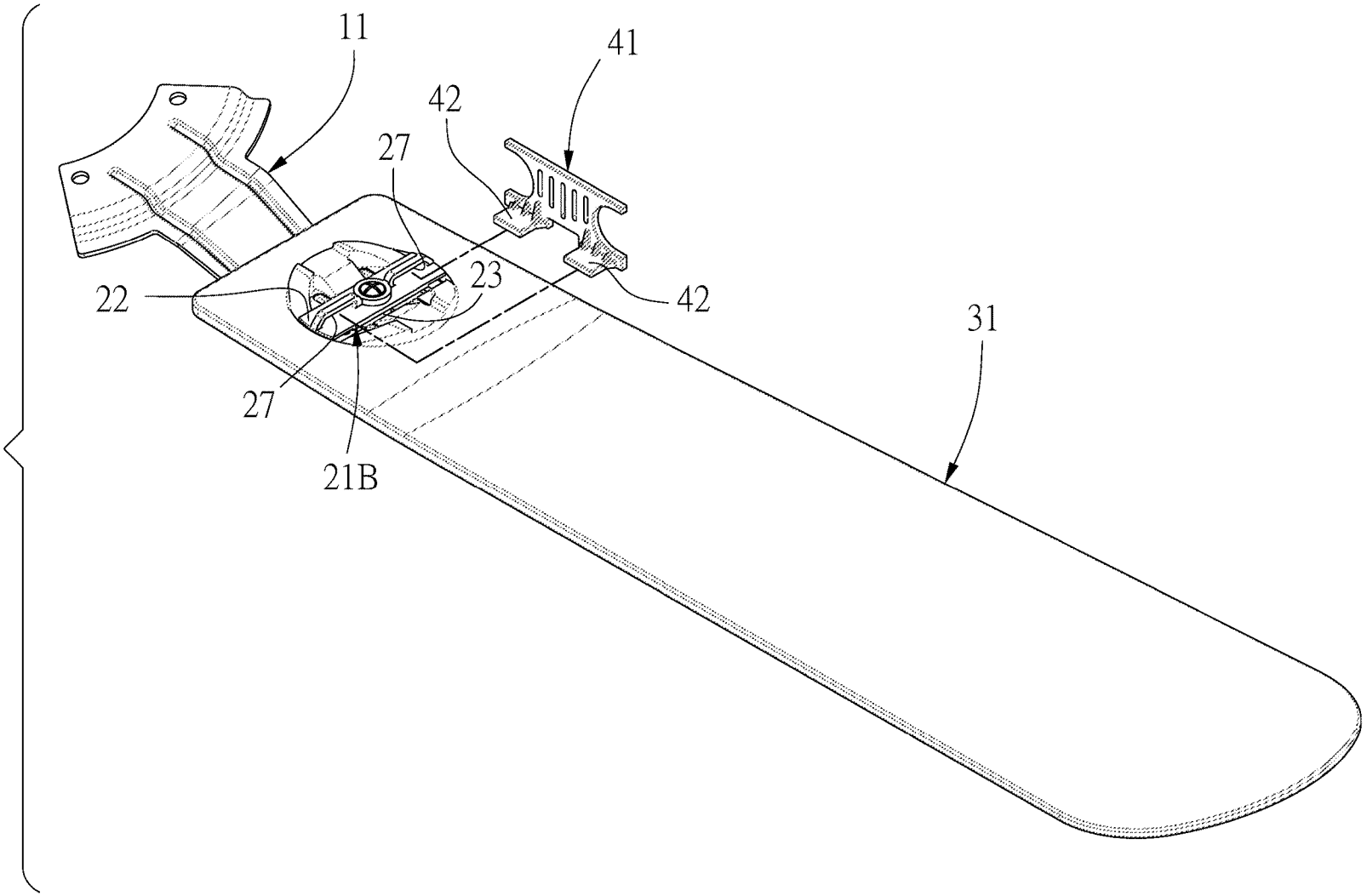
FIG. 8 and FIG. 9 are schematic views showing another implementation of the rotating member provided by the present invention.
Figure 9:
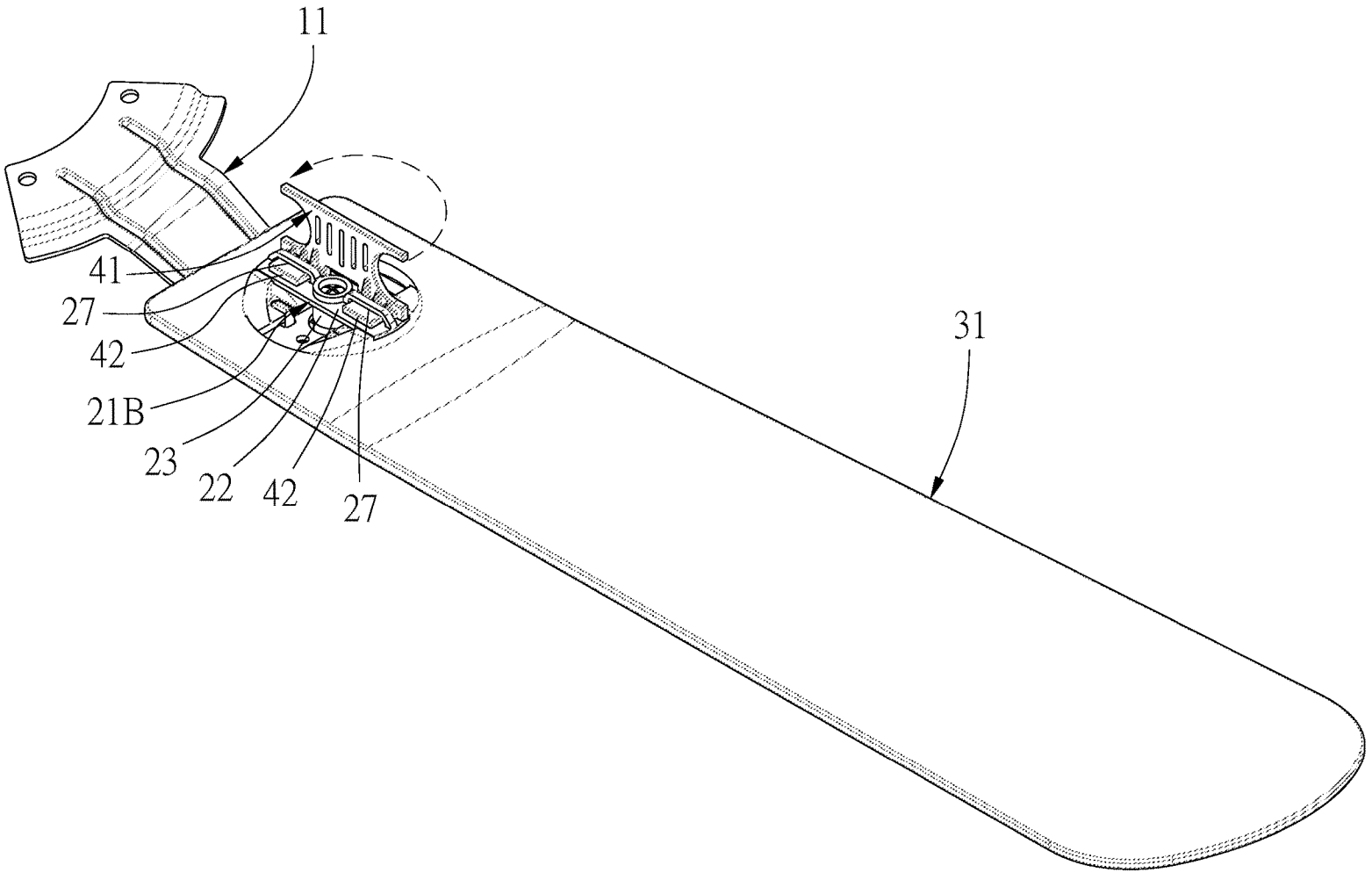

In addition, FIG. 8 and FIG. 9 show another implementation of the rotating member 21B provided by the present invention. The rotating member 21B also has the plate portion 22 in the form of an elongate plate and the sleeve portion 23 extending downward from the center of the plate portion 22. The rotating member 21B further has a pair of looking holes 27 that are arranged symmetrically on the upper end face of the plate portion 22. An operating plate 41 has two protrusions 42 that can be relatively locked in the pair of locking holes 27. When the two protrusions 42 of the operating plate 41 are relatively locked in the pair of locking holes 27, the user can use the operating plate 41 to rotate the rotating member 21B, having the function of assembling/disassembling the blade 31 quickly. The operating plate 41 may be removed after the assembly of the blade 31 is completed, so as to ensure the overall appearance of the blade 31 after it is assembled.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A ceiling fan blade snap-fit structure, comprising:

a blade holder, one end of the blade holder having a coupling seat, a rotating member being provided on the coupling seat, the rotating member being rotatable relative to the coupling seat, a plurality of posts being provided beside the rotating member;

a blade, having a coupling hole for the rotating member to pass therethrough, an engaging block being provided at either side of the coupling hole, an indentation being formed on a top of each engaging block, each engaging block having two slopes at two sides of the indentation, the slopes each extending downwardly toward the coupling hole, a bottom of each engaging block being formed with grooves for receiving the respective posts;

wherein when the rotating member passes through the coupling hole and the rotating member is rotated, two ends of the rotating member are moved along the corresponding slopes and engaged in the indentations of the respective engaging blocks.

2. The ceiling fan blade snap-fit structure as claimed in claim 1, wherein the end of the blade holder is formed with a plate-shaped connecting end, the coupling seat has a shaft extending upwardly for connecting the rotating member, the posts are located beside the shaft, the connecting end has through holes corresponding in position to the shaft and the respective posts, the shaft and the posts of the coupling seat pass through the respective through holes and extend out of an upper end face of the connecting end, and a plurality of screws are threadedly connected to the connecting end and the coupling seat, so that the coupling seat is locked to the connecting end.

3. The ceiling fan blade snap-fit structure as claimed in claim 2, wherein the number of the posts is four, and the posts are arranged symmetrically in pairs around the shaft.

4. The ceiling fan blade snap-fit structure as claimed in claim 2, wherein the coupling seat has a surrounding wall along a peripheral circumference thereof, a notch is formed on one side of the surrounding wall for the connecting end to be inserted therethrough, a plurality of recesses are formed on a side edge of the notch, facing the connecting end, and the connecting end includes a plurality of protruding ribs corresponding in position to the respective recesses, when the connecting end is connected to the coupling seat, the protruding ribs of the connecting end are engaged with the respective recesses of the coupling seat.

5. The ceiling fan blade snap-fit structure as claimed in claim 1, wherein the coupling seat has a shaft extending upwardly, the posts are located beside the shaft, the rotating member has a plate portion in the form of an elongate plate and a sleeve portion extending downward from a center of the plate portion, the sleeve portion of the rotating member is sleeved on the shaft so that the rotating member is rotatable relative to the shaft of the coupling seat, the shaft is locked with a positioning member located in the sleeve portion, and an elastic member is provided between a head end of the positioning member and an inner flange of the sleeve portion for generating a downward force against the rotating member.

6. The ceiling fan blade snap-fit structure as claimed in claim 5, wherein the rotating member further has a pair of hook portions extending upwardly from the plate portion, and the hook portions are symmetrically curved.

7. The ceiling fan blade snap-fit structure as claimed in claim 5, wherein the rotating member further has a pair of looking holes that are arranged symmetrically on an upper end face of the plate portion, an operating plate has two protrusions that can be relatively locked in the pair of locking holes, when the two protrusions of the operating plate are relatively locked in the pair of locking holes, the operating plate is used to drive the rotating member to rotate.

8. The ceiling fan blade snap-fit structure as claimed in claim 1, wherein the end of the blade holder is integrally formed with the coupling seat, the coupling seat has a shaft extending upwardly for connecting the rotating member, and the posts are located beside the shaft.

* * * * *